United States Patent [19]

Thomas

[11] Patent Number: 4,569,613

[45] Date of Patent: Feb. 11, 1986

[54] SNAP ON DEVICE FOR HARDCOVER RING BINDER

[76] Inventor: Ralph D. Thomas, 7104 Granada La., Fox Lake, Ill. 60020

[21] Appl. No.: 577,604

[22] Filed: Feb. 6, 1984

Related U.S. Application Data

[63] Continuation-in-part of Ser. No. 508,079, Jun. 27, 1983, Pat. No. 4,524,991.

[51] Int. Cl.[4] ..... B42F 9/00; B42D 17/00

[52] U.S. Cl. ..... 402/80 R; 281/45

[58] Field of Search ..... 402/70, 75, 80 R; 281/20, 45, 48; 49/462, 463; 52/398, 397, 399

[56] References Cited

U.S. PATENT DOCUMENTS

| | | | |
|---|---|---|---|
| 763,554 | 6/1904 | Greene | 281/20 |
| 1,197,314 | 9/1916 | Wells | 281/45 |
| 1,337,612 | 4/1920 | Miller | 281/20 |
| 1,891,814 | 12/1932 | Haskin | 402/80 R |
| 3,374,564 | 3/1968 | Balaban | 281/45 |
| 3,861,101 | 1/1975 | Whisson | 52/398 |
| 3,944,374 | 3/1976 | Young et al. | 402/80 R |
| 4,229,918 | 10/1980 | Delcroix | 52/398 |
| 4,486,032 | 12/1984 | Leahy | 281/48 |

*Primary Examiner*—Paul A. Bell
*Assistant Examiner*—Paul M. Heyrana, Sr.
*Attorney, Agent, or Firm*—Mathew R. P. Perrone, Jr.

[57] ABSTRACT

The snap on device having a U-shaped support with a pair of arcuate footers in the channel of the U-shaped support and a pair of grippers on each side of the U-shaped support adjacent the arcuate footers creates a device capable of being snapped onto a hard cover ring binder and equalizing the thickness of the binder from its spine to its opening side.

14 Claims, 3 Drawing Figures

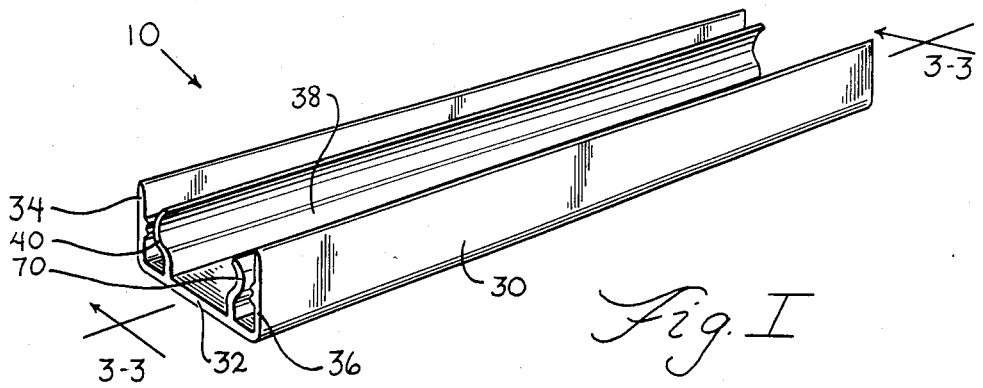
Fig. I
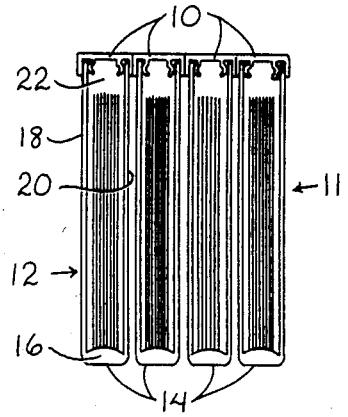
Fig. II
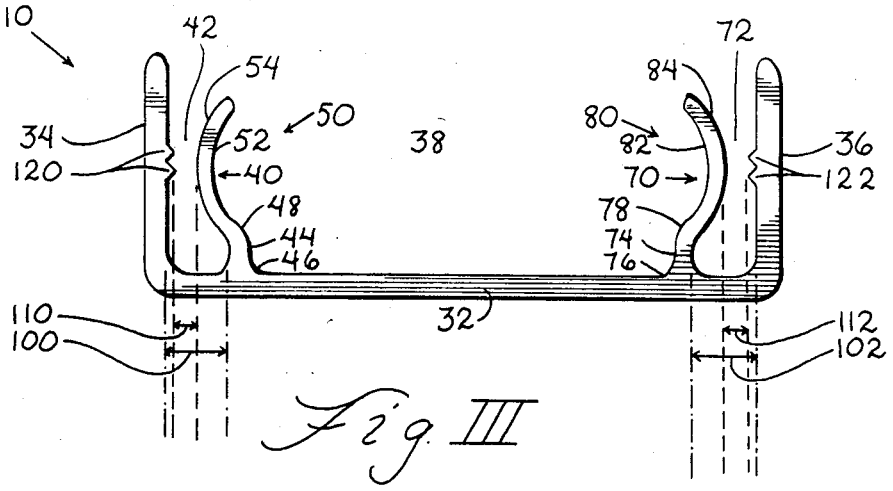
Fig. III

SNAP ON DEVICE FOR HARDCOVER RING BINDER

CROSS REFERENCE TO RELATED APPLICATION

This application is a continuation-in-part application of U.S. patent Ser. No. 508,079 filed June 27, 1983; now U.S. Pat. No. 4,524,991; by the same inventive entity.

BACKGROUND OF THE INVENTION

This invention relates to a device useful in assisting to make a ring binder more efficient to use, and more particularly a device capable of making the opening side of the binder substantially equal to the spine side of the ring binder.

Ring binders are in great use in various fields of endeavor. Students use them at all levels of education. Businesses use them to store information, and provide for readily changeable information. Other educational sources use them to provide books or other materials, which can be easily updated by merely changing the loose leaf sheets within the ring binder. Such ring binders have long been known in the art and have a wide variety of uses.

In spite of the long period of use of ring binders, some major problems still remain with the use of a ring binder. These problems greatly reduce the advantages of a ring binder. It is, of course, desirable to maintain the advantages of a ring binder while solving some of these problems.

One problem occurs because it is extremely difficult to properly stack or store a ring binder with other ring binders. The crux of this problem relates to the wedge shape of a ring binder, which interferes with the stacking or storing of a ring binder. A standard ring binder has a structure, which leads from a spine side to an opening side. The opening side is generally of less thickness than the spine side, which leads to a wedge shape. However, this problem is inherent in the nature of a ring binder.

Another problem occurs because the binder is designed to contain material. If the material is in the binder, the open side is not necessarily of equal thickness with the spine side. Furthermore, since the open side leaves the binder cover free to move relative to the other side of the binder cover, the binder may be opened at undesirable times. If a device could be found to equalize the width of the binder at the open side and at the spine side, great improvements in the use of a ring binder can result.

Furthermore, a frequent user of notebooks to carry material can, to great dismay, find that upon stuffing a three-ring binder or other binder into a briefcase or similar carrying device, another item within the briefcase has entered the binder and caused damage to the material therein. If the material is so damaged, it becomes unsightly and therefore unsuitable for the person to use in—for example—a sales presentation.

An even greater advantage is achieved if a device to achieve the desirable results can be simply manufactured. As the process for manufacture is simplified, production costs are reduced.

Thus, it becomes clear that it is highly desirable to have a device which improves the utility of the already versatile ring binder.

SUMMARY OF THE INVENTION

Therefore, it is an object of this invention to provide a device capable of rendering the ring binder stackable or storable.

It is a further object of this invention to provide a device capable of equalizing the open side width to the spine width.

Yet it is a further object of this invention to hold covers of a ring binder firmly closed.

Also, an object of this invention is to provide a device to protect materials within the ring binder itself.

Another object of this invention is to provide a device which is adjustable so as to fit a wide variety of ring binders.

Yet another object of this invention is to provide a device which is simple to manufacture.

These and other objects of this invention are met by providing a binder snap on device having a U-shaped support with arcuate binder contacts therein.

BRIEF DESCRIPTION OF THE DRAWINGS

FIG. I is a perspective view of binder snap on device 10 of this invention.

FIG. II is an end view of a plurality of snap on devices 10 of this invention used with a stack 11 of binders 12.

FIG. III is an end view of FIG. I.

Throughout the Figures of the Drawings, where the same part appears in more than one Figure, the same number is given thereto.

DESCRIPTION OF THE PREFERRED EMBODIMENTS

A snap on device; having a U-shaped support, with a pair of arcuate footers in the channel of the U-shaped support, and a pair of grippers on each side of the U-shaped support adjacent the arcuate footers; creates a device capable of being snapped onto a hard cover ring binder and equalizing the thickness of the binder from its spine to its opening side.

Referring now to FIG. I and FIG. II, which depicts a binder snap on device 10 of the invention used in a stack 11 by being secured in a removable fashion to a binder 12, the advantages of a binder snap on device 10 become clear.

As is known in the art a ring binder 12, includes a binder spine 14, having a paperlock 16 secured to the binder spine 14 within ring binder 12. Protruding from the binder spine at one side is first binder cover 18. Oppositely disposed from first binder cover 18 is second binder cover 20. Second binder cover 20 and first binder cover 18 combine to form a binder opening 22 encasing paperlock 16 therein. It is binder opening 22 which can cause problems by permitting implements or foreign material to enter the binder 12 and damage the sheets within the binder 12.

Binder snap on device 10 of this invention prevents this problem. Binder snap on device 10 alters the tapered shape of loose leaf hard cover ring binder 12 by substantially equalizing the thickness of binder 12 from its spine 14 to its binder opening 22. In this fashion, a number of binders 12 can be stacked at a neat, stable and orderly fashion. This device 10 also assists in preventing premature cracking or splitting of first binder cover 18 and second binder cover 20 by preventing undue stress thereon. Also device 10 by being removably secured to binder 12 prevents the entry of the other material in a briefcase into the binder opening 22 and damage to the material therein.

Referring now to FIG. I and FIG. III, binder snap on device 10 accomplishes these desired results by providing a U-shaped support 30, having a support base 32, with a first support edge 34, extending from support base 32, and a second support edge 36 extending from support base 32 and substantially parallel to first support edge 34. In a preferred embodiment, first support edge 34 and second support edge 36 are perpendicular to support base 32, and form a channel 38 therebetween. In most cases, clearly first support edge 34 and second support edge 36 respectively, are generally perpendicular to support base 32 at each long edge of the rectangularly-shaped support base 32. In this fashion, U-shaped support 30 is formed.

U-shaped support 30 includes a first arcuate footer 40 and a second arcuate footer 70 oppositely disposed therefrom within channel 38. First arcuate footer 40 is adjacent and substantially parallel to first support edge 34. Second arcuate footer 70 is adjacent and substantially parallel to second support edge 36. First arcuate footer 40 and second arcuate footer 70 are substantially mirror images of each other.

First arcuate footer 40 combines with first support edge 34 to form a first binder cover channel 42 therebetween. First binder cover channel 42 may receive either first binder cover 18 or second binder cover 20 when device 10 is in use.

First arcuate footer 40 has a first leg portion 44 substantially parallel to first support edge 34. First leg 44 has a first base end 46 which contacts support base 32. Oppositely disposed from first base end 46 on first leg portion 44 is first arc end 48. Attached to first arc end 48 is first arc contact 50. First arc contact 50 has a first concave side 52 and a first convex side 54. First convex side 54 is adjacent to, but sufficiently spaced from first support edge 34 to allow snap on device 10 to fit on binder 12.

Second arcuate footer 70 combines with first support edge 36 to form a second binder cover channel 72 therebetween. Second binder cover channel 72 may receive either first binder cover 18 or second binder cover 20 when device 10 is in use.

Second arcuate footer 70 has a second leg portion 74 substantially parallel to second support edge 36. Second leg portion 74 has a second base end 76 which contacts support base 32. Oppositely disposed from second base end 76 on second leg 74 is second arc end 78. Attached to second arc end 78 is second arc contact 80. Second arc contact 80 has a second concave side 82 and a second convex side 84. Second convex side 84 is adjacent to, but sufficiently spaced from second support edge 36 to allow snap on device 10 to fit on binder 12. It thus follows that first concave side 52 faces second concave side 82.

Thus it may be seen that device 10 has an axis of symmetry 90 along Line 3—3. In this fashion the desired results may be achieved.

First arcuate footer 40 has first leg portion 44 spaced a first leg distance 100 from first support edge 34. Second arcuate footer 70 has second leg 74 spaced a second leg distance 102 from second support edge 36. First leg distance 100 and second leg distance 102 are generally wider than either first binder cover 18 or second binder cover 20 when device 10 is in use.

More preferrably, first leg distance 100 and second leg distance 102 are about 1.1 to 3.5 times wider than either first binder cover 18 or second binder cover 20 is thick (depending on channel contacts which cover). Most preferrably, first leg distance 100 and second leg distance 102 are about 1.5 to 2.5 times wider than either first binder cover 18 or second binder cover 20 is thick. These factors relate to the thickness of the cover, with which contact is made.

First arc contact 50 and second arc contact 80 serve the function of reducing the width of first binder cover channel 42 and second binder cover channel 72 to less than the thickness of first binder cover 18 or second binder cover 20; so that they may flex and hold the respective devices in place on binder 12 to render binder 12 flat and storable. Thus first arc contact 50 forms with first support edge 34, a first arc channel 110; and second arc contact 80 forms with second support edge 36 a second arc channel 112. First arc channel 110 and second arc channel 112 are the closest points between the channel-forming elements. FIG. III illustrates this function.

Within first arc channel 110 on first support edge 34 are a pair of first grippers 120 running the length of first support edge 34. First grippers 120 cooperate with first arc contact 50 to grip either first binder cover 18 or second binder cover 20. Likewise, within second arc channel 112 on second support edge 36 are a pair of second grippers 122 running the length of second support edge 36. Second grippers 122 cooperate with second arc contact 80 to grip either first binder cover 18 or second binder 18. The device may also operate without grippers. Also, the grippers need not run the full channel length. Any number of grippers may be used. The grippers as shown, however, are preferred.

First grippers 120 and second grippers 122 may have any suitable cross-section. It is preferred, however, that the cross-section be in the form of a right triangle having the hypotneuse thereof on first support edge 34 and second support edge 36. More preferred is a forty-five (45°) degree right triangle.

More preferrably, first binder cover channel 52 and second binder cover channel 72 are reduced to 0.3 to 0.9 times the thickness of either first binder cover 18 or second binder cover 20 (depending on which channel contacts which cover). Most preferrably, first binder cover channel 52 and second binder cover channel 72 are reduced to about 0.4 to 0.7 times the thickness of either first binder cover 18 or second binder cover 20. These factors relate to the thickness of the cover, with which contact is made.

Appropriate material for making the device of this invention is that which can be flexible when thin and rigid when thick. The material may be plastic or synthetic resin. Metal may used for the rigid parts. A flexible and resilient metal may be used to contact and hold binder 12. Synthetic resin or plastic material is preferred material, with molding being the preferred process. Mixtures of materials of the same or different may be used.

The devices of this invention may be manufactured or assembled in any suitable way. The component parts may be assembled mechanically, or joined by chemical or thermobonding. The piece itself or the component parts thereof may be molded, formed, shaped, machined or otherwise formed into the proper shape and dimensions. Assembling of parts is a possible method of making device 10. Unitary molding of device 10 is also possible, and is in fact the preferred method of forming device 10. Any method, which may achieve the desired article is usable.

Because of this disclosure and solely because of this disclosure, various modifications to binder snap on device 10 can become clear to those having ordinary skill in the art. Such modifications are clearly covered hereby.

What is claimed and sought to be secured by Letters Patent of the United States is:

1. A device to be removably attached to an openable side of a ring binder for protecting material contained within said ring binder and for rendering said ring binder substantially flat to thereby simplify storing of at least one ring binder wherein:

a. said device includes a U-shaped support having a channel as an interior portion thereof; and b. a first arcuate footer means and a second arcuate footer means are secured within said channel to provide a flexible binder contact means for permitting said device to removably secured to said openable side and cooperating with said U-shaped support to render said ring binder flat and protect said material in said binder;

c. a first gripper means is on a first support edge of said U-shaped support and a second gripper means on a second support edge of said U-shaped support;

d. said first gripper means cooperating with a first member of said pair of arcuate footer means to hold said device on said binder; and e. said second gripper means cooperating with a second member of said pair of arcuate footer means to hold said device on said binder.

2. The device of claim 1 wherein:

a. said first arcuate footer includes an arc end oppositely disposed from said base end;

b. a first arc member extending from said arc end and having a convex side thereof adjacent said first support edge;

c. a first arc distance is between said first arc member and said first support edge, and less than a thickness of either said second binder cover or said first binder cover;

d. a first gripper means is on said first support edge and a second gripper means on said second support edge within said arc distance;

e. said first gripper means cooperating with said first arc member to hold said device on said binder; and f. a second arc member is on said second arcuate footer means cooperating with a second gripper means on said second support edge within said a second arc distance between said second support edge and said second arc member.

3. In combination, a ring binder, and a device for protecting material contained within said ring binder and for rendering said ring binder substantially flat to thereby simplify storing of at least one ring binder; said ring binder including a binder spine, a paperlock secured to said binder spine, a first binder cover movably secured to said binder spine at one side of said spine, a second binder cover oppositely disposed from first binder cover and movably secured to said binder spine at an opposing side of said spine, said second binder cover combining with said first binder cover to form a binder opening, said binder opening being oppositely disposed from said binder spine and encasing paperlock within said ring binder, wherein:

a. said device includes a U-shaped support having a channel as an interior portion thereof;

b. a first arcuate footer means and a second arcuate footer means are secured within said channel to provide a flexible binder contact means permitting said device to be removably secured to said binder opening and cooperating with said U-shaped support to render said ring binder flat and protect said material in said binder.

4. The combination of claim 3 wherein said U-shaped support includes a support base, a first support edge extending from said support base and a second support edge extending from said support base and substantially parallel to said first support edge.

5. The combination of claim 4 wherein said U-shaped support wherein said first support edge and said second support edge are substantially perpendicular to said support base to thereby form said channel therebetween, wherein the width of said first support edge is substantially equal to the width of said second support edge.

6. The combination of claim 5 wherein said first arcuate footer means includes a first leg portion substantially perpendicular to said support base, and adjacent to and at a first footer distance from said first support edge to form a first binder cover channel; and said second arcuate footer means includes a second leg portion substantially perpendicular to said support base, and adjacent to and at a second footer distance from said second support edge to form a second binder cover channel.

7. The combination of claim 6 wherein said first arcuate footer means is substantially a mirror image of said second arcuate footer means.

8. The combination of claim 7 wherein said footer distance and said second footer distance are each 1.1 to 3.5 times wider than said binder cover is thick.

9. The combination of claim 7 wherein said first footer distance and said footer distance are each 1.5 to 2.5 times wider than said binder cover is thick.

10. The combination of claim 8 wherein said flexible binder cover contact means reduces said the width of first binder cover channel and said second binder cover channel to less than the thickness of said binder cover.

11. The combination of claim 10 wherein said flexible binder cover contact means reduces said the width of first binder cover channel and said second binder cover channel to 0.3 to 0.9 times the thickness of said binder cover.

12. The combination of claim 11 wherein said flexible binder cover contact means reduces said the width of first binder cover channel and said second binder cover channel to 0.4 to 0.7.

13. The combination of claim 12 wherein:

a. a first gripper means is on said first support edge, and a second gripper means is on said second support edge; and b. said first gripper means and said second gripper means cooperate with said flexible binder cover contact means.

14. The combination of claim 13 wherein:

a. said first arcuate footer includes an arc end oppositely disposed from said base end;

b. a first arc member extending from said arc end and having a convex side thereof adjacent said first support edge;

c. a first arc distance is between said first arc member and said first support edge, and less than a thickness of either said second binder cover or said first binder cover;

d. said first gripper means and said second gripper means are within said arc distance;

e. said first gripper means cooperating with said first arc member to hold said device on said binder; and f. a second arc member is on said second arcuate footer means cooperating with a second gripper means on said second support edge within said a second arc distance between said second support edge and said second arc member.

* * * * *